US012558718B2

(12) United States Patent
Lee et al.

(10) Patent No.: US 12,558,718 B2
(45) Date of Patent: Feb. 24, 2026

(54) FORMING METHOD FOR STRUCTURE FOR REINFORCEMENT AND STRUCTURE FOR REINFORCEMENT

(71) Applicant: POSCO, Pohang-si (KR)

(72) Inventors: Hyoun-Young Lee, Incheon (KR); Jong-Youn Park, Seoul (KR)

(73) Assignee: POSCO CO., LTD, Pohang-si (KR)

( * ) Notice: Subject to any disclaimer, the term of this patent is extended or adjusted under 35 U.S.C. 154(b) by 783 days.

(21) Appl. No.: 17/297,949

(22) PCT Filed: Nov. 19, 2019

(86) PCT No.: PCT/KR2019/015840
§ 371 (c)(1),
(2) Date: May 27, 2021

(87) PCT Pub. No.: WO2020/111627
PCT Pub. Date: Jun. 4, 2020

(65) Prior Publication Data

US 2022/0097114 A1 Mar. 31, 2022

(30) Foreign Application Priority Data

Nov. 30, 2018 (KR) ..... 10-2018-0153093

(51) Int. Cl.
*B21D 19/08* (2006.01)
*B21D 22/26* (2006.01)
(Continued)

(52) U.S. Cl.
CPC ..... *B21D 19/08* (2013.01); *B21D 22/26* (2013.01); *B21D 47/01* (2013.01); *B21D 53/88* (2013.01)

(58) Field of Classification Search
CPC ..... B21D 19/08; B21D 22/26; B21D 47/01; B21D 5/16; B21D 22/02; B21D 22/20
(Continued)

(56) References Cited

U.S. PATENT DOCUMENTS 4,338,808 A * 7/1982 Weiss ..... E04D 13/068 248/48.2
6,474,128 B1 * 11/2002 Liu ..... B21D 5/16 72/379.2
(Continued)

FOREIGN PATENT DOCUMENTS

CN 107683185 A 2/2018
JP H05-23761 A 2/1993
(Continued)

OTHER PUBLICATIONS

Extended European Search Report dated Dec. 13, 2021 issued in European Patent Application No. 19891134.9.
(Continued)

*Primary Examiner* — Adam J Eiseman
*Assistant Examiner* — Fred C Hammers
(74) *Attorney, Agent, or Firm* — Morgan Lewis & Bockius LLP

(57) ABSTRACT

The present invention relates to a method for forming a reinforcement structure, and the reinforcement structure. The method for forming a reinforcement structure according to the present invention may include: a first forming step of bending an edge of a steel plate in a first direction to form a side flange, which forms a flange angle with the bottom surface of the steel plate; a second forming step of bending the steel plate in a second direction to form a pair of side wall flanges, and bending at least a portion of the side flange in a direction opposite the first direction; and a third forming step of bending the side flange in the first direction.

5 Claims, 13 Drawing Sheets

(51) Int. Cl.
*B21D 47/01* (2006.01)
*B21D 53/88* (2006.01)

(58) Field of Classification Search
USPC ..... 72/379.2
See application file for complete search history.

(56) References Cited

U.S. PATENT DOCUMENTS

| | | | | |
|---|---|---|---|---|
| 10,022,764 | B2 | 7/2018 | Nishimura et al. | |
| 10,577,027 | B2 | 3/2020 | Ito | |
| 10,717,123 | B2 | 7/2020 | Ito et al. | |
| 2008/0250837 | A1* | 10/2008 | Durney | B21D 51/52 52/648.1 |
| 2011/0252657 | A1* | 10/2011 | Sato | G01R 1/06716 33/561 |
| 2013/0213109 | A1 | 8/2013 | Ogasawara | |
| 2014/0119811 | A1* | 5/2014 | Henniger | B21D 5/16 403/187 |
| 2015/0061323 | A1 | 3/2015 | Otsuka et al. | |
| 2015/0174634 | A1 | 6/2015 | Nishimura et al. | |
| 2016/0279692 | A1* | 9/2016 | Ito | B21D 22/26 |
| 2017/0008573 | A1 | 1/2017 | Otsuka et al. | |
| 2018/0133778 | A1 | 5/2018 | Tanaka et al. | |

FOREIGN PATENT DOCUMENTS

| | | | |
|---|---|---|---|
| JP | 2008-189126 | A | 8/2008 |
| JP | 2013-169578 | A | 9/2013 |
| JP | 5958644 | B2 | 8/2016 |
| JP | 6265315 | B1 | 1/2018 |
| KR | 10-2015-0113052 | A | 10/2015 |
| KR | 10-2016-0113211 | A | 9/2016 |
| KR | 10-1821909 | B1 | 1/2018 |
| KR | 10-1914822 | B1 | 11/2018 |
| WO | 2013/154114 | A1 | 10/2013 |
| WO | 2016/088665 | A1 | 6/2016 |

OTHER PUBLICATIONS

Chinese Office Action dated Aug. 19, 2022 issued in Chinese Patent Application No. 201980073888.2.
International Search Report dated Feb. 28, 2020 issued in International Patent Application No. PCT/KR2019/015840 (with English translation).

* cited by examiner

【Figure 5】
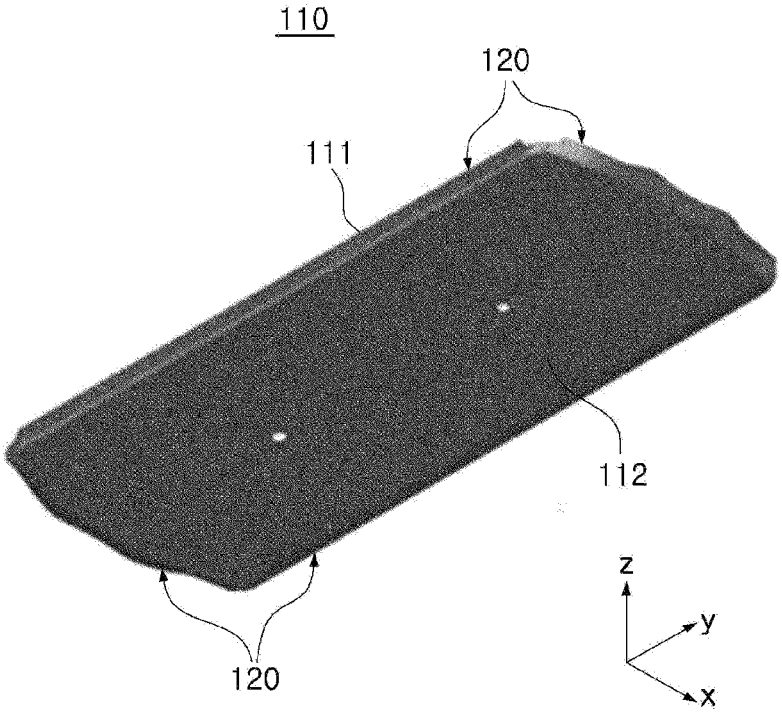

【Figure 6】
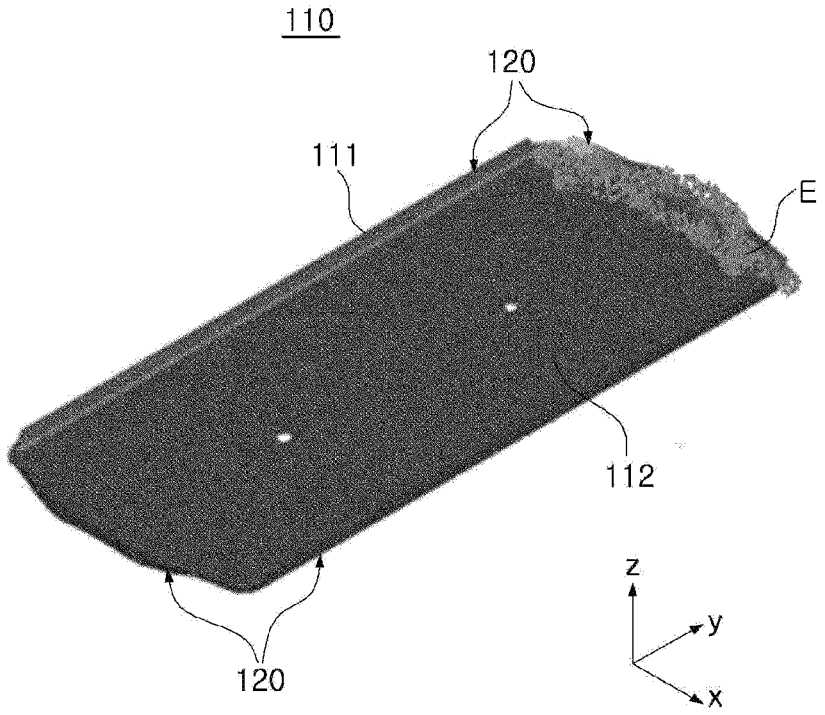

【Figure 7】
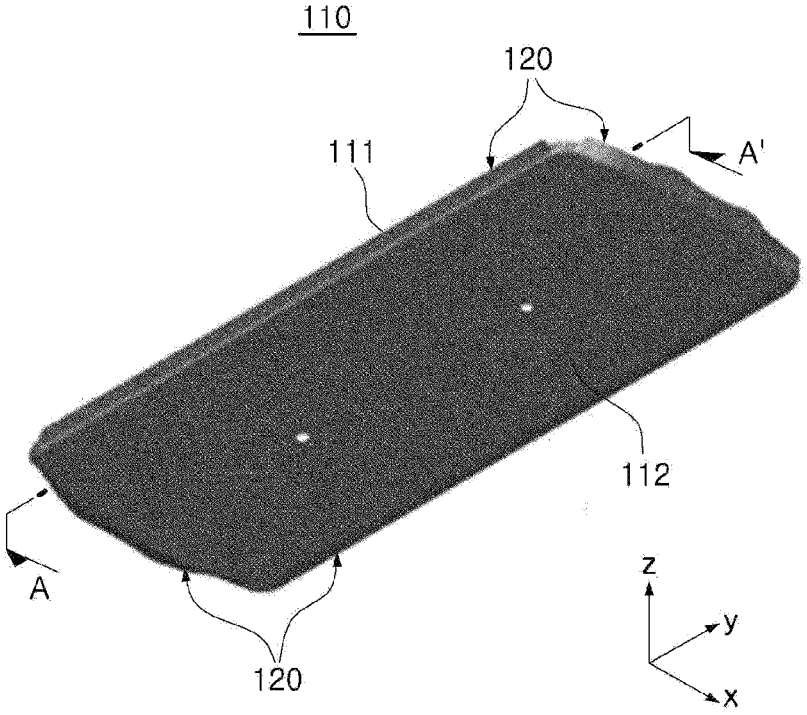
【Figure 8】
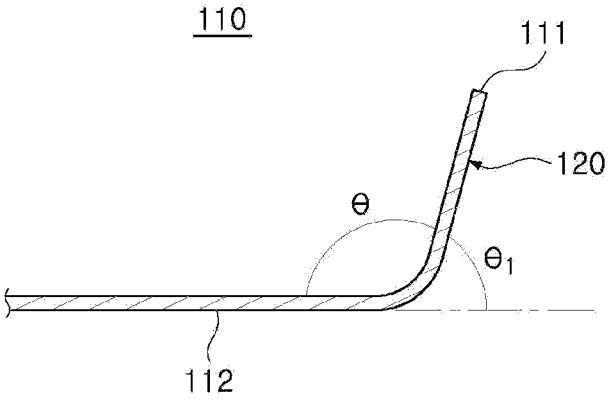
A – A'

【Figure 9】
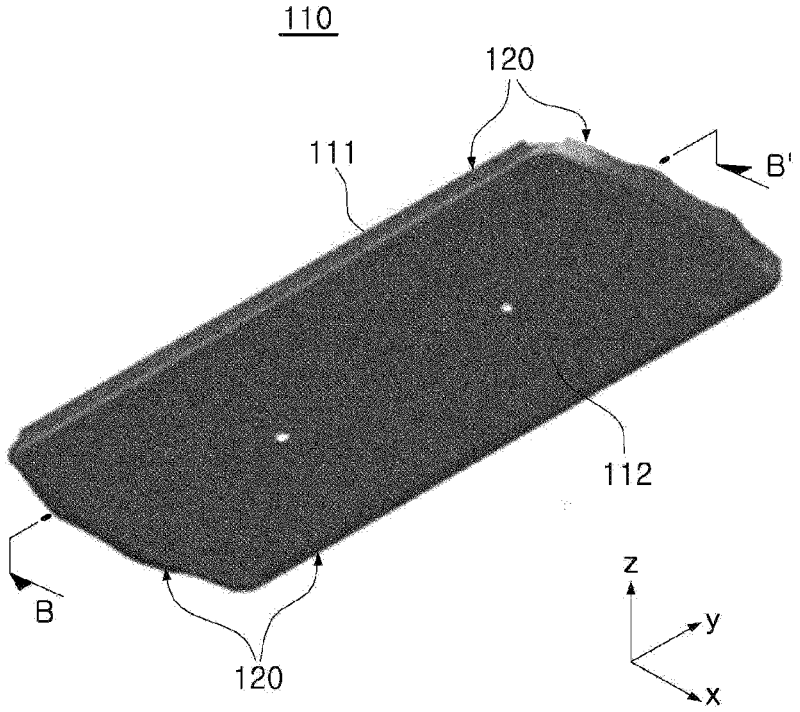

【Figure 10】
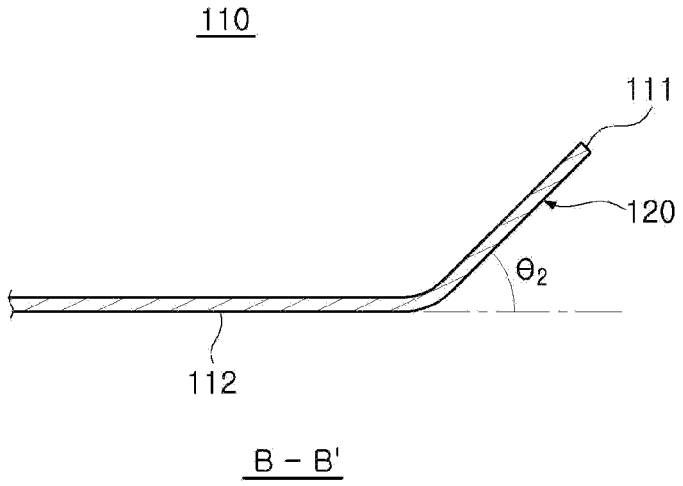
【Figure 11】
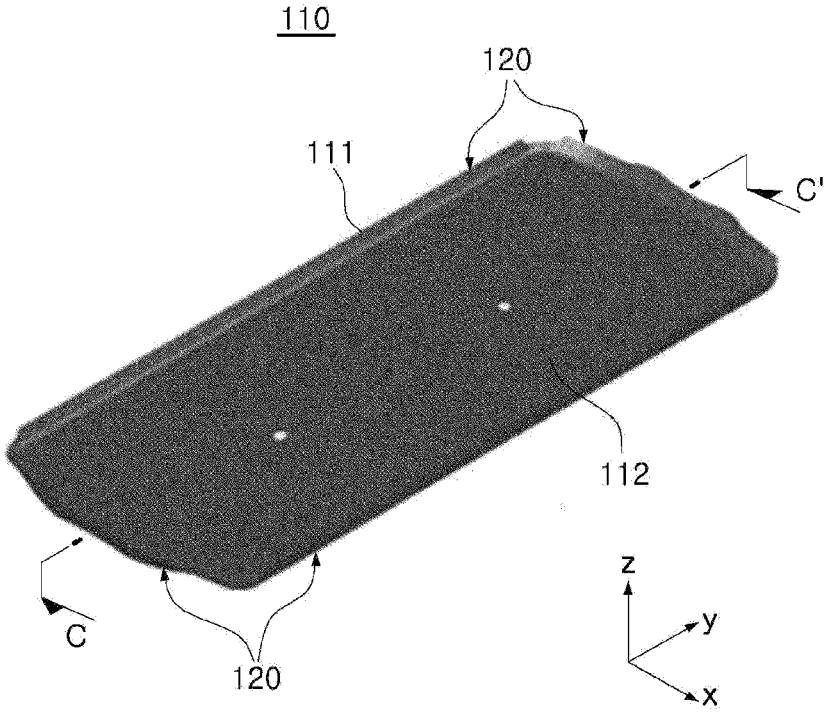

C – C'

【Figure 16】
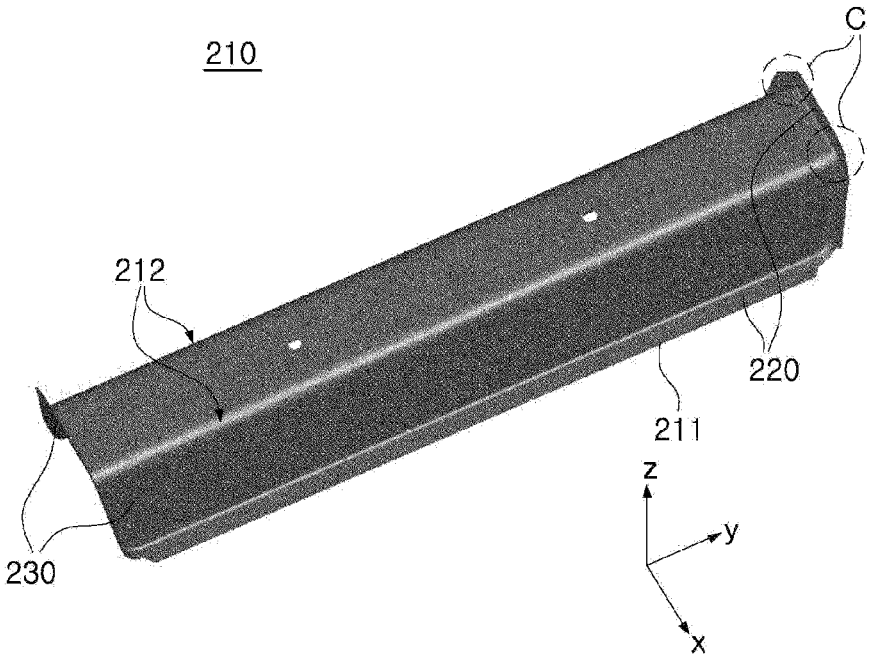

【Figure 17】
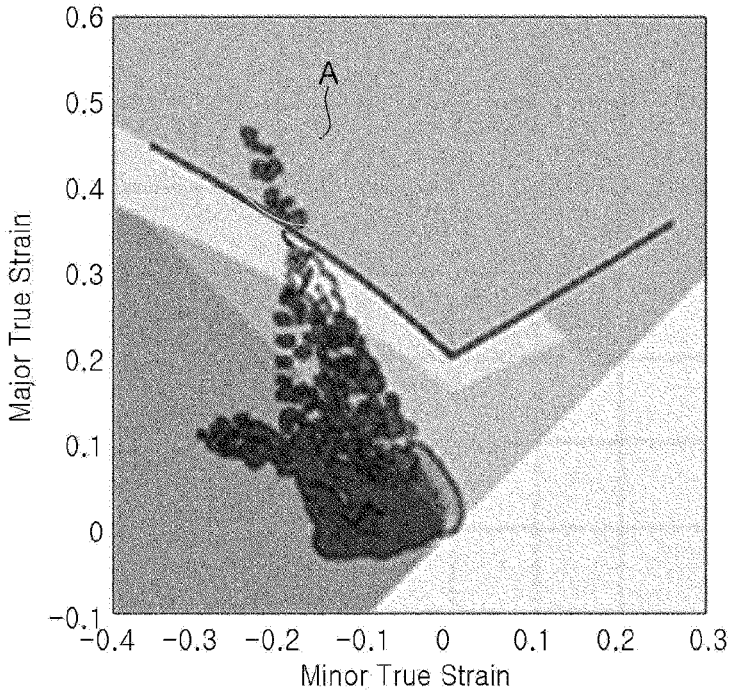

【Figure 18】
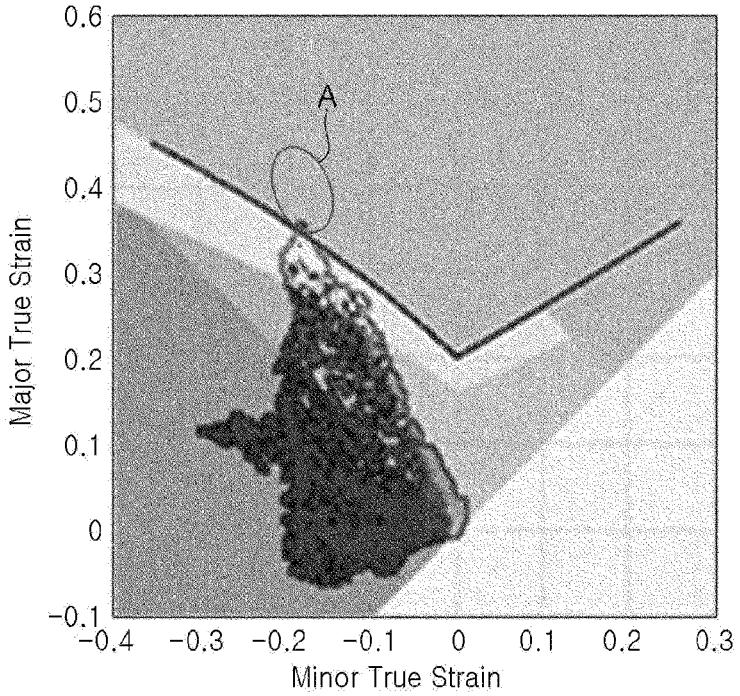

FORMING METHOD FOR STRUCTURE FOR REINFORCEMENT AND STRUCTURE FOR REINFORCEMENT

CROSS-REFERENCE OF RELATED APPLICATIONS

This application is the U.S. National Phase under 35 U.S.C. § 371 of International Patent Application No. PCT/KR2019/015840, filed on Nov. 19, 2019, which in turn claims the benefit of Korean Application No. 10-2018-0153093, filed on Nov. 30, 2018, the entire disclosures of which applications are incorporated by reference herein.

TECHNICAL FIELD

The present disclosure relates to a method of forming a reinforcing structure, and a reinforcing structure.

BACKGROUND ART

Numerous parts forming an automobile may have various flange structures for bonding of related parts.

FIG. 1 schematically illustrates an automobile structural member 10 of the related art, and the automobile structural member 10 formed by molding a steel plate may have a structure bent in a '⊏' shape, in which a side wall flange 10*b* and a lower flange 10*a* are connected.

However, in the process of press molding for forming the automobile structural member 10, deformation is concentrated in a flange corner portion 11 at which the side wall flange 10*b* and the lower flange 10*a* meet, as illustrated in FIG. 2.

Since the flange corner portion 11 in which the deformation is concentrated is susceptible to deformation or breakage, a notch portion 12 has been formed by cutting the flange corner portion of the structural member 10 as illustrated in FIG. 3.

However, the notch 12 as above causes a gap between automobile parts, and there is a problem of lowering the connection rigidity of the parts.

Patent document: KR 10-1914822 B1 (Oct. 29, 2018)

DISCLOSURE

Technical Problem

An aspect of the present disclosure is to improve the rigidity of automobile reinforcing structure itself, and to improve the connection rigidity and load transfer characteristics between automotive parts.

Technical Solution

The present disclosure relates to a method of forming a reinforcing structure, and a reinforcing structure.

According to an aspect of the present disclosure, a method of forming a reinforcing structure includes a first forming operation of forming a side flange to form a flange angle with a bottom surface of a steel plate by folding up an edge of the steel plate in a first direction; a second forming operation of forming a pair of side wall flanges by folding the steel plate in a second direction, and simultaneously, bending at least a portion of the side flange in a direction opposite to the first direction; and a third forming operation of folding up the side flange in the first direction.

In the first forming operation, the steel plate may be folded up such that the side flange formed on one side of the steel plate is bent, and the side flange may be bent by folding up an edge of the steel plate such that the bottom surface of the steel plate and the side flange form different angles.

In the second forming operation, the pair of side wall flanges facing each other may be formed, by folding the bottom surface of the steel plate in the second direction to form a pair of corners.

In the second forming operation, an upper flange, a partial region of the bottom surface of the steel plate, may be present between the pair of side wall flanges, and the steel plate may be folded in such a manner that the pair of side wall flanges are spaced apart from each other by the upper flange.

In the second forming operation, at least portions of the upper flange and the side flange may be formed to be located at the same height, by folding the side flange having the same height as the upper flange and a height higher than the upper flange in a direction other than the first direction.

The third forming operation may be performed by folding up at least a portion of the side flange having the same height as the upper flange in the first direction.

The third forming operation may be performed by folding up at least a portion of the side flange in the first direction to return the at least portion of the side flange to a position of the first forming operation.

In the first forming operation, a virtual extension line of the bottom surface of the steel plate and the side flange may respectively form a first angle, a second angle, and a third angle. The first angle may be a value greater than 0° and less than or equal to 90°, the second angle may be a value greater than 0° and less than or equal to 60°, and the third angle may be a value that exceeds 0° and is less than or equal to the flange angle.

In the second forming operation, the pair of side wall flanges may be formed by folding the steel plate in such a manner that the virtual extension lines of the pair of corners are on the same line with the side flange forming the second angle.

According to another aspect of the present disclosure, a reinforcing structure includes a body plate formed of an integral steel plate; a side flange portion formed by folding an edge of the body plate in one direction; and a pair of side wall flange portions formed by folding the body plate in a direction different from the side flange. The side flange portion is connected to corners of the pair of side wall flanges and the body plate.

The side flange portion may be continuously formed from one of the side wall flange portions to the other of the side wall flange portions.

Advantageous Effects

According to an exemplary embodiment, the formability and rigidity of the automobile reinforcing structure may be improved, and the connection rigidity and load transfer characteristics between automobile parts may be improved.

DESCRIPTION OF DRAWINGS

FIGS. 5 to 7 are perspective views of a reinforcing structure according to an exemplary embodiment of the present disclosure.

FIG. 8 is a cross-sectional view taken along line A-A' of FIG. 7.

FIG. 9 is a perspective view of a reinforcing structure according to an exemplary embodiment of the present disclosure.

FIG. 10 is a cross-sectional view taken along line B-B' of FIG. 9.

FIG. 11 is a perspective view of a reinforcing structure according to an exemplary embodiment of the present disclosure.

FIGS. 14 to 16 are perspective views of a reinforcing structure according to an exemplary embodiment of the present disclosure.

FIG. 17 is a forming limit curve of the related art reinforcing structure.

FIG. 18 is a forming limit curve of a reinforcing structure according to an exemplary embodiment of the present disclosure.

BEST MODE FOR INVENTION

Figure 1:
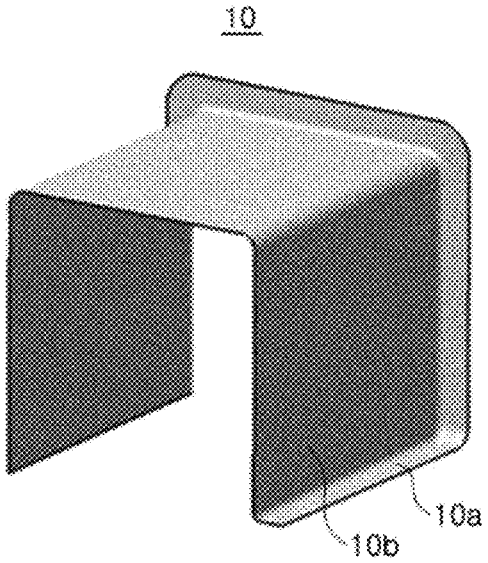
Prior Art FIG. 1
FIG. 1 schematically illustrates a related art reinforcing structure.
Figure 2:
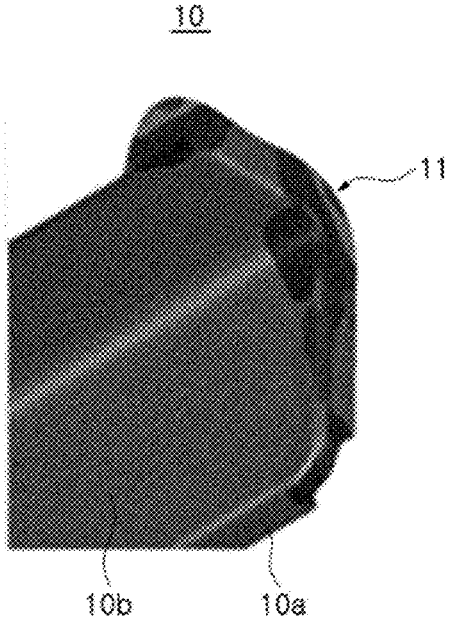
Prior Art FIG. 2
FIG. 2 schematically illustrates the results of analysis of molding of a related art reinforcing structure.
Figure 3:
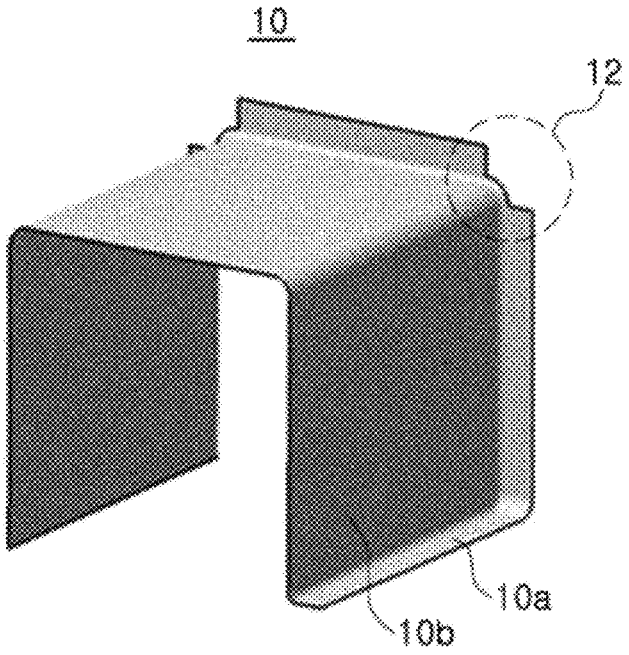
Prior Art FIG. 3
FIG. 3 schematically illustrates a notch portion of a related art reinforcing structure.

In order to aid in understanding the description of the embodiments of the present disclosure, the elements described with the same reference numerals in the accompanying drawings are the same elements, and among the components that perform the same function in embodiments, related components are indicated by numbers on the same or extended line.

In addition, in order to clarify the gist of the present disclosure, descriptions of elements and techniques well known by the prior art will be omitted, and hereinafter, the present disclosure will be described in detail with reference to the accompanying drawings.

However, the spirit of the present disclosure is not limited to the presented embodiments, and specific components may be added, changed, or deleted by those skilled in the art to be proposed in other forms, but this is also included within the scope of the same spirit as the present disclosure.

The X-axis and Y-axis illustrated in the accompanying drawings are the width and length directions of the steel sheet, and the Z-axis direction is the thickness direction. However, this direction may be changed due to the characteristics of the steel sheet and the forming process.

Figure 4:
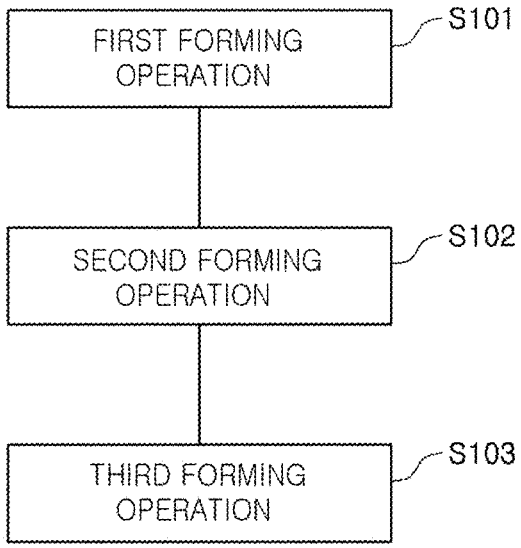
FIG. 4 illustrates a method of forming a reinforcing structure according to an exemplary embodiment of the present disclosure.

As illustrated in FIG. 4, a method of forming a reinforcing structure according to an exemplary embodiment of the present disclosure may include a first forming operation (S101) of forming a side flange forming a flange angle with the bottom surface of the steel plate by folding up an edge of a steel plate in a first direction, a second forming operation (S102) of folding the steel sheet in a second direction to form a pair of side wall flanges, and simultaneously therewith, bending at least a portion of the side flanges in a direction opposite to the first direction, and a third forming operation (S103) of folding up the side flange in the first direction. In this case, in the second forming operation (S102), at least a portion of the side flange may be bent or folded down in a direction opposite to the first direction to be flattened, and in the third forming operation (S103), the side flange folded flat in the second forming operation S102 may be folded up in the first direction.

According to such a forming method, the deformation applied to the flange of the steel plate is evenly distributed to prevent the steel plate from being torn or broken due to the concentration of the deformation at any one point, in detail, the flange corner.

In addition, since the deformation is uniformly distributed in the steel plate flange, it is not necessary to form a notch by cutting the corner of the flange, such that a reinforcing structure having a continuous flange without a notch may be formed, and thus, the rigidity of the reinforcing structure itself may be improved.

In addition, the connection and coupling between automobile parts may be improved by the continuous flange, and airtightness and watertightness may also be improved to block noise of the automobile, and safety may also be improved.

First, the first forming operation may include a process of folding up the steel plate so that a side flange 120 formed on one side of the steel plate 110 illustrated in FIG. 5 is bent and collecting the material flesh so that the side of the steel plate 110 is bent.

The side flange 120 may be formed by folding up the edge of the steel plate 110 in one direction. The side flange 120 formed as described above may be disposed at least parallel to the Z-axis direction, and may be disposed in a bent shape to form a predetermined angle with a bottom surface 112.

The rectangular steel plate 110 includes four sides, and the side flange 120 may be formed on each of the four sides.

In addition, in an exemplary embodiment of the present disclosure, among the four side flanges, a pair of side flanges 120 present in the region in which the corner portion of the flange is formed may be formed to be bent, and to this end, the edge 111 of the steel plate is folded up, thereby forming the side flange 120.

The deformation region of the steel plate 110 on which the side flange 120 is formed is illustrated in FIG. 6, and as illustrated in FIG. 6, a deformation region E of the steel plate is uniformly generated throughout the side flange 120.

As illustrated in FIG. 7, to form a bend in the side flange 120, the edge 111 of the steel plate 110 may be folded up such that the angles formed by the bottom surface 112 and the side flange 120 of the steel plate 110 are different from each other in the X-axis direction.

First, as illustrated in FIG. 8, the edge 111 of the steel plate 110 may be folded up such that the virtual extension line of the bottom surface 112 and the side flange 120 of the steel plate 110 form a first angle $\theta_1$.

Figure 12:
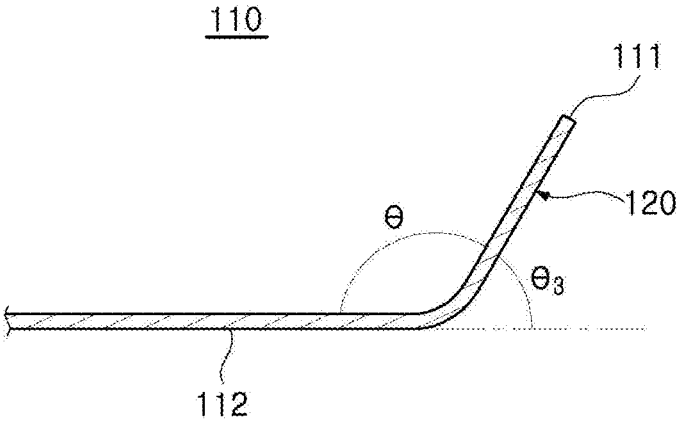
FIG. 12 is a cross-sectional view taken along line C-C' of FIG. 11.

In addition, as illustrated in FIGS. 9 and 10, the edge 111 of the steel plate 110 is folded and raised such that the virtual extension line of the bottom surface 112 and the side flange 120 of the steel plate 110 form a second angle $\theta_2$. In addition, as illustrated in FIGS. 11 and 12, the edge 111 of the steel plate 110 may be folded and raised such that the virtual extension line of the bottom surface 112 and the side flange 120 of the steel plate 110 form a third angle $\theta_3$.

For example, the edge 111 may be folded in the X-axis direction such that the virtual extension line of the bottom surface 112 and the side flange 120 of the steel plate 110 form the first, second, and third angles ($\theta_1$, $\theta_2$, $\theta_3$).

At this time, the bottom surface 112 and the side flange 120 of the steel plate 110 form a flange angle ($\theta$ in FIG. 8). In this operation, the flange angle ($\theta$ in FIG. 8) may have different values in the X-axis direction in FIG. 7.

In an exemplary embodiment of the present disclosure, the first angle ($\theta_1$ in FIG. 8) may be any one value that is greater than 0° and is less than or equal to 90°, the second angle ($\theta_2$ in FIG. 10) may be any one value that is greater than 0° and is less than or equal to 60°, and the third angle ($\theta_3$ in FIG. 12) may be any one value that exceeds 0° and is less than or equal to the flange angle ($\theta$ in FIG. 8).

In this case, the flange angle ($\theta$ in FIG. 8) may change or may be provided as the same angle in the X-axis direction, and may also be an angle that is formed by the non-curved side flange (120 in FIG. 11) formed on another side of the steel plate 120, and the bottom surface 112.

In addition, the first, second, and third angles ($\theta_1$, $\theta_2$, and $\theta_3$) may be formed at a time by one movement of the press mold.

However, this is a matter that may be appropriately selected and applied by a person skilled in the art in consideration of the characteristics of the steel plate and the characteristics of the process.

Figure 13:
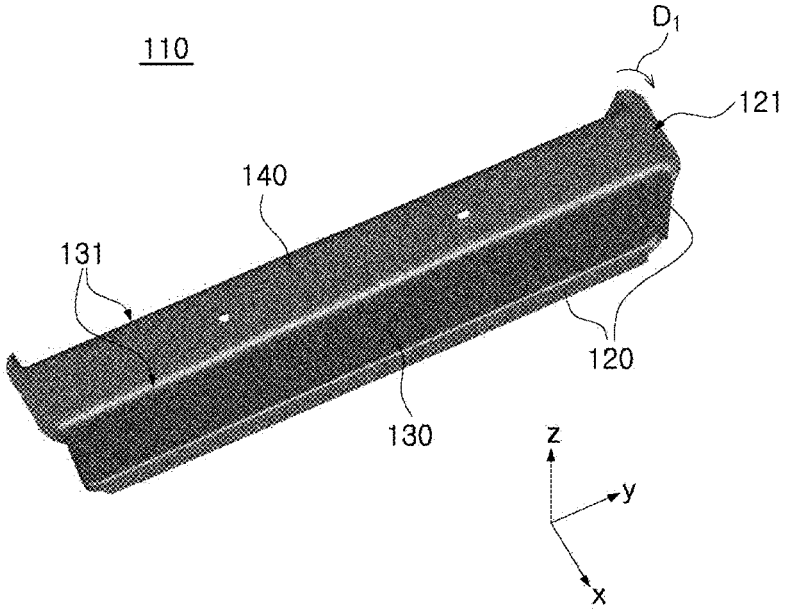
FIG. 13 is a perspective view of a reinforcing structure according to an exemplary embodiment of the present disclosure.

As illustrated in FIG. 13, following the first forming as above, first, the second molding operation may include a process of forming a pair of sidewall flanges 130 facing each other by folding the bottom surface 112 of the steel plate 110 in the second direction, not in the first direction, for example, not the direction in which the side flange 120 is formed by folding up the edge (111 in FIG. 12) of the steel plate, to form a pair of corners 131.

In this case, in the process, an upper flange 140, which is a partial region of the bottom surface 112 of the steel plate, is present between the pair of sidewall flanges 130, and the steel plate may be folded such that the pair of sidewall flanges 130 are spaced apart from each other by the upper flange 140.

In addition, the second forming operation includes a process of folding the edge of the steel plate (111 in FIG. 12) in a direction (D1) other than the first direction in which it was folded so that at least a portion of the upper flange 140 and the side flange 120 are at the same height in the Z-axis, to form the side flange 120 having the same height in the Z-axis direction as the upper flange 140 and a height higher in the Z-axis direction than the upper flange 140 while forming the upper flange 140 as described above.

Figure 14:
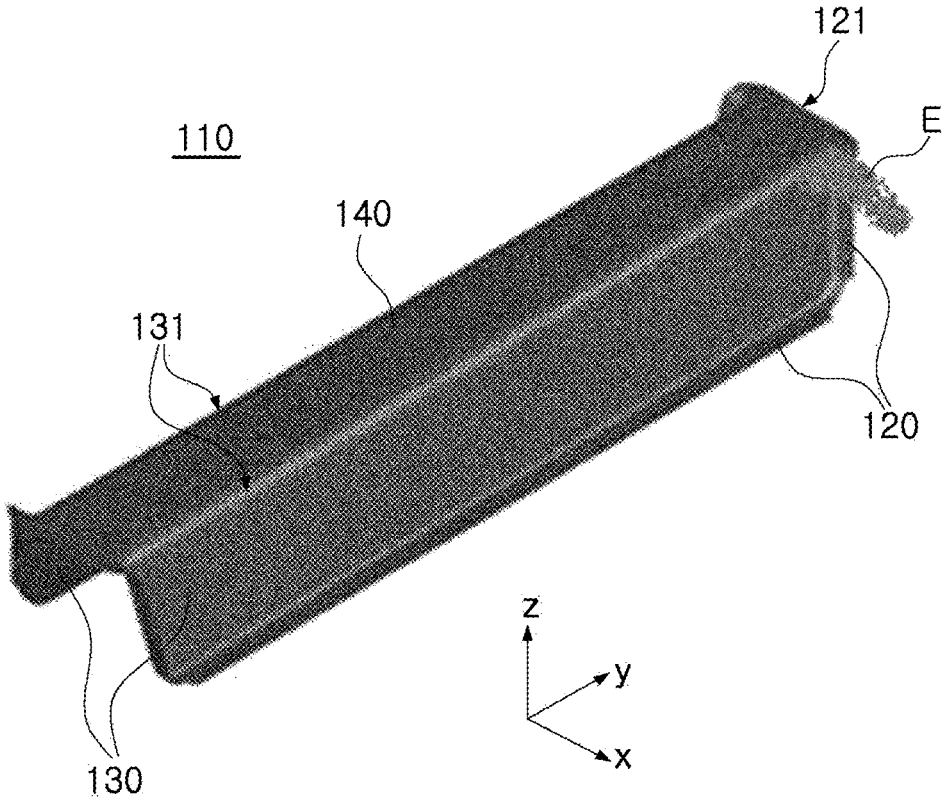

For example, by folding down at least a portion of the side flange 120 to be flat, deformation is applied to the corner portion at which the side flange 120, the side wall flange 130, and the upper flange 140 meet, so that stretching does not occur at the corner. The steel plate 110 has the deformation region E as illustrated in FIG. 14.

In the process of forming the side wall flange 130 and forming a flat portion 121, the area of the side flange (120 in FIG. 11) where the material flesh was collected is elongated. In this case, since the flat portion 121 is formed flat, the side wall flange 130 may be formed without tearing or cracking of the corner portion of the flange.

In detail, in the second forming operation, the steel plate 110 may be folded to form a pair of corners 131 and side wall flanges 130, in such a manner that the extension lines of the pair of corners 131 are on the same line as the area of the side flange 120 forming the second angle ($\theta_2$ in FIG. 10) in the first forming operation, for example, on the same height in the Z-axis.

In consideration of the deformation applied when forming the side wall flange 130, by applying a deformation to the area corresponding to the second angle ($\theta_2$ in FIG. 10) folded at a smallest angle such that the side wall flange 130 may be formed, the deformation may be uniformly divided and applied to the area of the steel plate 110.

In this manner, the process of forming the side wall flange 130 and the flat portion 121 may also be performed at a time by one movement of the press mold.

Figure 15:
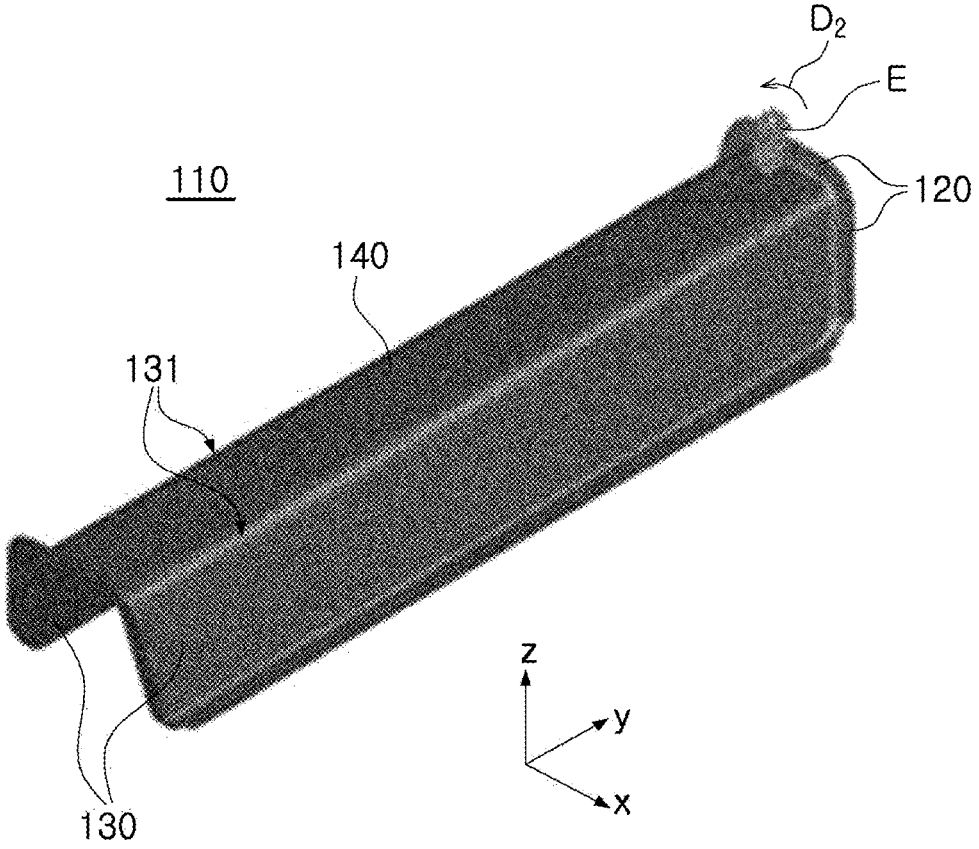

Subsequently, as illustrated in FIG. 15, the third forming operation may include a process of folding up at least a portion of the side flange having the same height as the upper flange, for example, the flat portion (121 in FIG. 14), in the same direction D2 as the direction in which the edge has been folded up when forming the side flange 120, for example, in the first direction.

Then, another deformation region E is formed, and it can be seen that the deformation region E is formed in a region different from the deformation region formed in the second forming operation (E in FIG. 14), thereby preventing fracture and cracking due to the concentration of deformation. In addition, there is no need to form a notch by cutting out the corner of the flange in which the deformation is concentrated.

In addition, in an exemplary embodiment of the present disclosure, it can be seen that the deformation region (E) in the first, second, and third forming operations is not concentrated in the flange corner or any one region, but is distributed over the entire area of the side flange 120, the upper flange 140, and the side wall flange 130.

Accordingly, according to the method of forming the reinforcing structure according to an exemplary embodiment of the present disclosure, the continuous side flange 120 without a notch portion may be formed without breaking and cracking of the steel plate 110.

On the other hand, a reinforcing structure according to another embodiment of the present disclosure is provided.

As illustrated in FIG. 16, the reinforcing structure according to an exemplary embodiment may include a body plate 210 formed of an integral steel plate, a side flange portion 220 formed by folding an edge of the body plate in one direction, and a pair of sidewall flange portions 230 formed by folding the body plate in a direction different from the direction of the side flange.

In this case, the side flange portion 220 is connected to the pair of side wall flange portions 230 and the corners 212 of the body plate 210. In addition, the side flange portion is continuously formed along the edge of the body plate 210.

For example, in the reinforcing structure according to an exemplary embodiment of the present disclosure, the side flange portion 220 is continuously formed in the X-axis, Y-axis, and Z-axis, and does not include a discontinuous notch portion.

In an exemplary embodiment of the present disclosure, it can be appreciated that a strain section (A) beyond the limit line as illustrated in FIG. 18 is significantly less than a strain section (A) occurring in the forming limit curve of the related art reinforcing structure illustrated in FIG. 17, such that the possibility of fracture and deformation is relatively reduced.

Therefore, there is no reason to form the flange corner portion as a notch portion, and since the continuous side flange portion may be formed, the connection and coupling between automobile parts may be improved compared to the related art reinforcing structure, and the airtightness and watertightness are also improved, and thus the noise of the automobile may be blocked, and there is an effect of improving safety.

The matters described above are described in relation to an embodiment of the present disclosure, and the scope of the present disclosure is not limited thereto, and various modifications and variations are possible within the scope not departing from the technical spirit of the present disclosure described in the claims, and this will be apparent to those of ordinary skill in the art.

The invention claimed is:

1. A method of forming a reinforcing structure, comprising:

a first forming operation of forming a side flange to form a flange angle with a bottom surface of a steel plate by folding up an edge of the steel plate in a first direction;

a second forming operation of forming a pair of side wall flanges by folding the steel plate in a second direction, and simultaneously, bending at least a portion of the side flange in a direction opposite to the first direction; and a third forming operation of folding up the side flange in the first direction, wherein in the first forming operation, the steel plate is folded up such that the side flange formed on one side of the steel plate is bent, and the side flange is bent by folding up an edge of the steel plate such that the bottom surface of the steel plate and the side flange form different angles, wherein in the second forming operation, the pair of side wall flanges facing each other is formed, by folding the bottom surface of the steel plate in the second direction to form a pair of corners, wherein in the second forming operation, an upper flange, a partial region of the bottom surface of the steel plate, is present between the pair of side wall flanges, and the steel plate is folded in such a manner that the pair of side wall flanges are spaced apart from each other by the upper flange, wherein in the second forming operation, at least portions of the upper flange and the side flange are formed to be located at the same height, by folding the side flange having the same height as the upper flange and a height higher than the upper flange in a direction other than the first direction, wherein the second forming operation is performed so that at least a portion of the side flange, which is a flat portion, is at the same height as the upper flange, and deformation is applied to the corner portion at which the side flange, the side wall flange, and the upper flange meet, so that stretching does not occur at the corner, wherein the third forming operation is performed by folding up at least a portion of the side flange, which is the flat portion, having the same height as the upper flange in the first direction, and the first forming operation, the second forming operation, and the third forming operation are performed sequentially.

2. The method of forming a reinforcing structure of claim 1, wherein the third forming operation is performed by folding up at least a portion of the side flange in the first direction to return the at least portion of the side flange to a position of the first forming operation.

3. The method of forming a reinforcing structure of claim 1, wherein in the first forming operation, a virtual extension line of the bottom surface of the steel plate and the side flange respectively form a first angle, a second angle, and a third angle, wherein the first angle is a value greater than 0° and less than or equal to 90°, the second angle is a value greater than 0° and less than or equal to 60°, and the third angle is a value that exceeds 0° and is less than or equal to the flange angle.

4. The method of forming a reinforcing structure of claim 3, wherein in the second forming operation, the pair of side wall flanges is formed by folding the steel plate in such a manner that the virtual extension lines of the pair of corners are on the same line with the side flange forming the second angle.

5. The method of forming a reinforcing structure of claim 1, comprising performing, in order, the first forming operation, the second forming operation, and the third forming operation.

* * * * *